US008659225B2

(12) United States Patent
Panyik et al.

(10) Patent No.: US 8,659,225 B2
(45) Date of Patent: Feb. 25, 2014

(54) HIGH INTENSITY DISCHARGE LAMP WITH CROWN AND FOIL IGNITION AID

(75) Inventors: Tamas Panyik, Budapest (HU); Zoltan Janki, Budapest (HU); Janos Kallay, Budapest (HU); Agoston Boroczki, Budapest (HU)

(73) Assignee: General Electric Company, Schenectady, NY (US)

( * ) Notice: Subject to any disclaimer, the term of this patent is extended or adjusted under 35 U.S.C. 154(b) by 75 days.

(21) Appl. No.: 13/275,908

(22) Filed: Oct. 18, 2011

(65) Prior Publication Data

US 2013/0093319 A1 Apr. 18, 2013

(51) Int. Cl.
*H01J 61/54* (2006.01)
*H01J 61/35* (2006.01)

(52) U.S. Cl.
USPC ..... 313/594; 313/635

(58) Field of Classification Search
USPC ..... 313/54, 234, 594, 607, 631, 635; 315/59, 330, 335; 362/217.16, 221
See application file for complete search history.

(56) References Cited

U.S. PATENT DOCUMENTS

| | | | | |
|---|---|---|---|---|
| 4,037,129 | A | 7/1977 | Zack | |
| 4,053,809 | A | 10/1977 | Fridrich et al. | |
| 4,445,073 | A | 4/1984 | Wyner et al. | |
| 4,491,766 | A | 1/1985 | Larson | |
| 5,325,017 | A | 6/1994 | Schellen et al. | |
| 5,541,480 | A | 7/1996 | Renardus et al. | |
| 5,661,367 | A | 8/1997 | Fellows et al. | |
| 5,955,845 | A | 9/1999 | Fellows | |
| 6,172,462 | B1 * | 1/2001 | Gibson et al. | 313/594 |
| 6,198,223 | B1 | 3/2001 | Scholz | |
| 6,201,348 | B1 | 3/2001 | Nortrup et al. | |
| 6,222,320 | B1 | 4/2001 | Stockwald | |
| 6,844,676 | B2 | 1/2005 | Alderman et al. | |
| 6,861,805 | B2 | 3/2005 | Jackson et al. | |
| 6,943,498 | B2 | 9/2005 | Nishiura et al. | |
| 6,995,513 | B2 | 2/2006 | Alderman et al. | |
| 7,331,837 | B2 | 2/2008 | Jackson et al. | |

(Continued)

FOREIGN PATENT DOCUMENTS

| | | | |
|---|---|---|---|
| DE | 102004035931 | A1 | 2/2006 |
| DE | 202010010561 | U1 | 9/2010 |

(Continued)

OTHER PUBLICATIONS

Dictionary definiation of foil, retrieved on Aug. 1, 2013.*

(Continued)

*Primary Examiner* — Nimeshkumar Patel
*Assistant Examiner* — Steven Horikoshi
(74) *Attorney, Agent, or Firm* — Pearne & Gordon LLP

(57) ABSTRACT

A high intensity discharge lamp includes an electrically insulating arc tube including a central portion with an interior discharge region and two legs each extending from an end of the central portion. The central portion is a larger size than the legs. Electrical conductors extend through each of the legs and are spaced apart from each other in the discharge region. A light transmitting envelope encloses the arc tube. A frame member is electrically attached to one of the conductors. An ignition aid includes an electrically conductive foil disposed around one of the legs and in electrical contact with the frame member. An electrically conductive crown disposed in electrical contact with the foil is located on or near the central portion.

20 Claims, 11 Drawing Sheets

(56) References Cited

U.S. PATENT DOCUMENTS

| | | | | |
|---|---|---|---|---|
| 7,852,004 | B2 | 12/2010 | Li et al. | |
| 7,884,549 | B2 | 2/2011 | Scholler et al. | |
| 2002/0185973 | A1 | 12/2002 | Jackson et al. | |
| 2003/0006705 | A1 | 1/2003 | Alderman | |
| 2003/0025455 | A1 | 2/2003 | Alderman et al. | |
| 2003/0173902 | A1 | 9/2003 | Venkataramani et al. | |
| 2004/0227445 | A1 | 11/2004 | Kai | |
| 2005/0194908 | A1 | 9/2005 | Dakin et al. | |
| 2006/0119274 | A1* | 6/2006 | Dakin et al. | 315/56 |
| 2008/0211971 | A1* | 9/2008 | Pradhan | 348/743 |
| 2008/0303402 | A1 | 12/2008 | Li et al. | |
| 2009/0009084 | A1 | 1/2009 | Bonigk et al. | |
| 2009/0224675 | A1 | 9/2009 | Pekarski et al. | |
| 2009/0251053 | A1 | 10/2009 | Ramaiah | |
| 2009/0322224 | A1* | 12/2009 | Kostrun et al. | 313/594 |
| 2009/0322225 | A1 | 12/2009 | Kostrun et al. | |
| 2011/0074285 | A1 | 3/2011 | Buttstaedt et al. | |
| 2012/0139412 | A1* | 6/2012 | Brauner et al. | 313/623 |
| 2012/0146497 | A1 | 6/2012 | Stockwald | |
| 2012/0146498 | A1 | 6/2012 | Utsubo | |

FOREIGN PATENT DOCUMENTS

| | | | |
|---|---|---|---|
| DE | 102009029867 | A1 | 12/2010 |
| EP | 453652 | A2 | 8/1995 |
| EP | 967631 | A1 | 12/1999 |
| EP | 722184 | A2 | 9/2000 |
| EP | 1069596 | A2 | 1/2001 |
| EP | 1220298 | A1 | 7/2002 |
| EP | 938127 | A1 | 10/2002 |
| EP | 1298706 | A2 | 4/2003 |
| EP | 1037259 | B1 | 10/2003 |
| EP | 1355345 | A1 | 10/2003 |
| EP | 1006561 | B1 | 6/2004 |
| EP | 1033742 | A2 | 7/2005 |
| EP | 1626435 | A2 | 2/2006 |
| EP | 834905 | B1 | 11/2008 |
| EP | 2171743 | A2 | 4/2010 |
| EP | 2306492 | A1 | 4/2011 |
| JP | 2001283781 | A | 10/2001 |
| JP | 2001345076 | A | 12/2001 |
| JP | 2004095539 | A | 3/2004 |
| JP | 2006173108 | A | 6/2006 |
| JP | 2010010132 | A | 1/2010 |
| JP | 2010010135 | A | 1/2010 |
| WO | 9742651 | A2 | 11/1997 |
| WO | 9807180 | A1 | 2/1998 |
| WO | 0077826 | A1 | 12/2000 |
| WO | 0237532 | A1 | 5/2002 |
| WO | 02091428 | A2 | 11/2002 |
| WO | 03019616 | A2 | 3/2003 |
| WO | 2004001793 | A1 | 12/2003 |
| WO | 2005104183 | A2 | 11/2005 |
| WO | 2006076879 | A1 | 7/2006 |
| WO | 2008154102 | A2 | 12/2008 |
| WO | 2009049661 | A1 | 4/2009 |
| WO | 2010149458 | A1 | 12/2010 |
| WO | 2011018118 | A1 | 2/2011 |
| WO | 2011018122 | A1 | 2/2011 |
| WO | 2011018326 | A1 | 2/2011 |
| WO | 2011018327 | A1 | 2/2011 |
| WO | WO 2011018326 | A1 * | 2/2011 |
| WO | 2011038975 | A1 | 4/2011 |
| WO | WO 2011108176 | A1 * | 9/2011 |

OTHER PUBLICATIONS

PCT Invitation to Pay Additional Fees dated Dec. 13, 2012 from corresponding Application No. PCT/US2012/055292.

Partial Search Report from corresponding International Application No. PCT/US2012/045513, dated Oct. 26, 2012.

PCT Search Report and Written Opinion dated Apr. 8, 2013 from corresponding Application No. PCT/US2012/055292.

* cited by examiner

HIGH INTENSITY DISCHARGE LAMP WITH CROWN AND FOIL IGNITION AID

FIELD OF THE INVENTION

This disclosure relates to high intensity discharge lamps, and in particular, to ignition aids used in such lamps.

BACKGROUND OF THE INVENTION

Differences exist in speed of breakdown and the number of electrons needed to initiate a self-sustained discharge, but the underlying breakdown mechanism is the same for low pressure discharges (e.g., fluorescent lamps) or high pressure discharges (arc discharge lamps). Discharge is initiated between two conductors that are given opposite electric potential. The space between the conductors usually comprises a gas, and efforts are made to maintain the quality/purity of the gas by enclosing it in a hermetic vessel. The essential end result of the discharge is the creation of a plasma between the two conductors. Plasma is defined as a conductive medium, containing equal proportions of electron and ions, which allows for conduction of electric current through an otherwise insulator material, i.e., the gas in its initial state.

Initially, the gas contained in the arc tube is non-conductive. If an electric potential is applied on the conductors, this creates a favorable situation to strip the outer orbital electrons from the atoms of the gas and thus create free electrons, which are then accelerated though the gas by the electric field generated between the conductors, and initiates more electrons by collision with gas atoms, which in turn are ionized. If the electric field is high enough, each electron thus created will create additional electrons by inelastic collisions with gas atoms and ions, and initiates an electron avalanche. Such an avalanche creates the discharge. However, to create such electrons by simple dielectric breakdown of the gas atoms by the electric field requires several kilovolts of electric potential. Higher and higher electric potentials require more expensive external electrical circuitry, and may not be commercially feasible. Unwanted breakdown can also occur in the outer jacket and in the cap-base region.

Discharges for commercial applications employ an additional source of free electrons, which removes the need for generating such high voltages to initiate the discharge. Such external sources can be a heated filament, use of the ever present cosmic rays, or providing a source of electrons by radioactive decay. Heated filaments are not practical in high intensity discharge (HID) lamps, and the cosmic ray background radiation is insufficient to dramatically reduce the need for very high electric fields needed to initiate the ignition, unless other methods are used to lower the breakdown voltage.

For providing a source of electrons by radioactive decay, typically what has been used in the past in the HID arc tube is a radioactive gas, such as $Kr^{85}$ with most of the decay products being beta particles (i.e., electrons). $Kr^{85}$ has a half-life of 10.8 years, with 99.6% of the decay products being beta particles (i.e., electrons) having a maximum kinetic energy of 687 kev. These electrons have very high energy, and in many respects are an ideal source for free electrons and used widely as such for these applications. But to provide enough of these high energy electrons by radioactive decay, significant quantity of this gas has been used in HID lamps.

The presence of $Kr^{85}$ in such lamps diminishes the need for providing very high electric potential on the conductors, which makes the external electrical circuitry (a ballast) and systems design simpler and more cost effective. Typical applications use such a radioactive gas with a ballast that provides a high electric pulse for a very short duration, typically in the millisecond (microsecond) range, that is very effective in creating the electron avalanche referred to earlier. However, recent UN2911 government regulations limit the amount of radioactive $Kr^{85}$ used in lamps. These regulations proscribe the HID lamp manufacturers from using the large quantity of $Kr^{85}$ gas that has been previously used, as described in preceding paragraph.

A number of ignition aids have been designed for improving the ignition of high intensity discharge lamps. U.S. Patent application Pub. No. 2002/0185973 discloses a lamp in which wire is wrapped around both legs of the arc tube and its central body as both an ignition aid and for containment, but is not connected to the electrodes. Another reference, U.S. Pat. No. 5,541,480, discloses an ignition aid in which a conductor that is coated on an exterior surface of an arc tube of constant diameter between the electrodes is connected to a conductive frame wire that contacts an electrode. U.S. Pat. No. 6,222,320 discloses an ignition aid for a lamp including an arc tube having a central body portion and smaller diameter legs extending from the body portion, wherein a conductor that is in contact with a conductive frame wire that contacts one of the electrodes, contacts only the central body portion of the arc tube.

BRIEF DESCRIPTION OF THE INVENTION

A need to reduce the $Kr^{85}$ content in HID lamps exists, but such reduction could have serious consequence to discharge initiation, and consequently unacceptable performance. This invention describes a means to obviate this disadvantage of lowering the $Kr^{85}$ gas content.

It should be appreciated that terms such as upper, lower, top, bottom, right, left, and the like are relative terms that will change with the orientation of the lamp. These terms are used for improving understanding in this disclosure and should not be used to limit the invention as defined in the claims.

In general, this disclosure features a high intensity discharge lamp comprising an electrically insulating arc tube including a central portion with an interior discharge region and two legs each extending from an end of the central portion. The central portion is a larger size (e.g., diameter) than the legs. Electrical conductors extend through each of the legs and are spaced apart from each other in the discharge region. A light transmitting envelope encloses the arc tube. A frame member is electrically attached to one of the conductors. An ignition aid comprises an electrically conductive foil and crown. The foil is disposed around one of the legs and in electrical contact with the frame member. An electrically conductive crown in electrical contact with the foil is located on or near the central portion.

Referring to specific features, each of the legs can include an elongated portion and a larger sized plug portion that is received in an opening at the end of the central portion. In one aspect the crown can be an integral part of the foil. The crown that is an integral part of the foil can be spaced apart from the plug portion. In another aspect, the crown comprises a crown coating on the end of the central portion. The crown coating may be thinner than the foil. The crown coating can be disposed on the plug portion forming the crown; a coating can also extend from the crown coating onto one of the legs in contact with (e.g., under) the foil. The crown or crown coating can include a plurality of ribs extending generally outwardly of the foil. The ribs can be various shapes including but not limited to triangular, rounded, rectangular or trapezoidal. The foil can be electrically attached to the frame member, by welding for example, at only one end of the foil, the other end of the foil being unattached. Alternatively, the foil can be electrically attached to the frame member at one end, for example by welding, and can be electrically attached to itself at the other end (e.g., by welding) after a central part of the foil between the ends is wrapped around the leg. Instead of welding, the foil may be attached to the frame member and to itself such as by crimping or other manner known in the art like brazing.

There can be an inert gas mixture and a dose of mercury and metal halides sealed in the discharge region. The mixture of inert gases including argon and/or xenon gas, and $Kr^{85}$ gas, which are present in the discharge region can have an activity concentration of not greater than 0.16 MBq/liter. The foil and the crown can be comprised of a base metal selected from the group consisting of Nb, Mo, Ta, Pt, Re, W, Ni, Fe and combinations thereof, or a combination of any of the base metals with cladding comprised of one or more of the base metals. The electrical conductors can include a first conductor to which voltage is applied and a second conductor (which can be held to ground, for example). The first conductor can be at positive potential while the second conductor is at negative potential, for example. The frame member is electrically connected to the second conductor and the foil is disposed around one of the legs but electrically insulated from the first conductor. A thickness of the foil can range from 0.05 to 0.2 mm, and in particular from 0.05-0.15 mm. A thickness of the crown coating can be not more than 0.03 mm. A percentage of an area of the end face of the central portion that is covered by the crown coating can range from 15-100% and, in particular, from 40-100%, in particular 15-80%, and in particular 40-80%. This surface area includes the covered area of the plug portion including a part having a curvature and ends at the flat tapered portion of the arc tube leg. An angle $\alpha$ between adjacent ribs ranges from 0-15°. A number of ribs n ranges from 1-20. A length of each rib Lrib ranges from 10-70% of the outer diameter of the central portion of the arc tube. An angle $\beta$ between a plane parallel to a central axis along which the arc tube leg extends, and each rib, ranges from 10-80°. The foil should touch the leg surface that is not curved. It should be aligned in contact to the leg surface but it should not reach the curved part of the plug portion. The crown part covers the curved part and beyond in a non-contacting manner. The foil part is wrapped around the leg surface completely in contact with the leg in principle. However, in practice there may be portions of the foil as it wraps around the leg that do not contact the leg.

Many additional features, advantages and a fuller understanding of the invention will be had from the accompanying drawings and the Detailed Description of the Invention that follows. It should be understood that the above Brief Description of the Invention describes the invention in broad terms while the following Detailed Description of the Invention describes the invention more narrowly and presents embodiments that should not be construed as necessary limitations of the broad invention as defined in the claims.

DETAILED DESCRIPTION OF THE INVENTION

Figure 1:
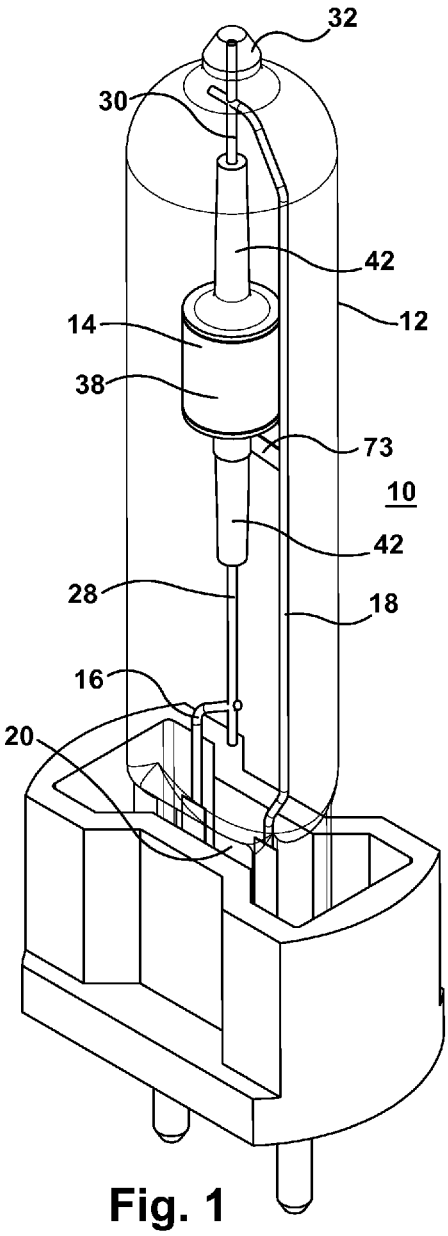
FIG. 1 is a side elevational view of a single ended high intensity discharge lamp with foil and crown ignition aid of this disclosure.

Referring to FIG. 1, a ceramic metal halide high intensity discharge lamp 10 includes an outer shroud or bulb 12 enclosing an arc tube 14. This is a single ended lamp in that electrical contacts are located on only one end of the lamp. Electrically conductive frame members or wires 16, 18 are embedded in a glass pinch portion 20 at one end of the outer bulb 12. Leads 22 extending from contact pins 24 external to the outer bulb 12 are electrically connected to the frame wires 16, 18 by electrically conductive foil 26 located in the pinch portion 20. Each foil 26 is welded to one of the leads 22 and to one of the frame wires 16, 18. Electrically conductive feedthroughs 28, 30 extend into each end of the arc tube. The lower feedthrough 28 is welded to the short frame member 16 while the upper feedthrough 30 is welded to the long frame member 18. The upper feedthrough 30 extends upwardly past the connection with the long frame member 18 and is retained in place by being in contact with a portion 32 of glass of the outer bulb that has been partially melted around the feedthrough 30 during manufacturing. The long frame member 18 extends along the length of the arc tube but is spaced apart from a side 34 of the arc tube 14 near a side wall 36 of the outer bulb 12. The frame members 16, 18 are formed of rigid wire and support the arc tube 14 inside the outer bulb 12 preventing its movement.

Figure 2A:
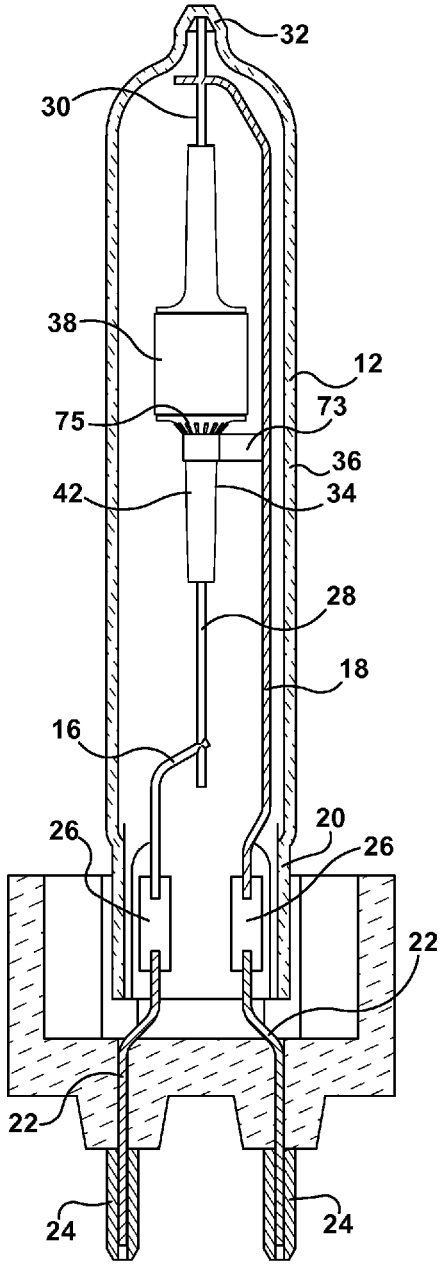
FIG. 2A is a vertical cross-sectional view of the lamp of FIG. 1.
Figure 2B:
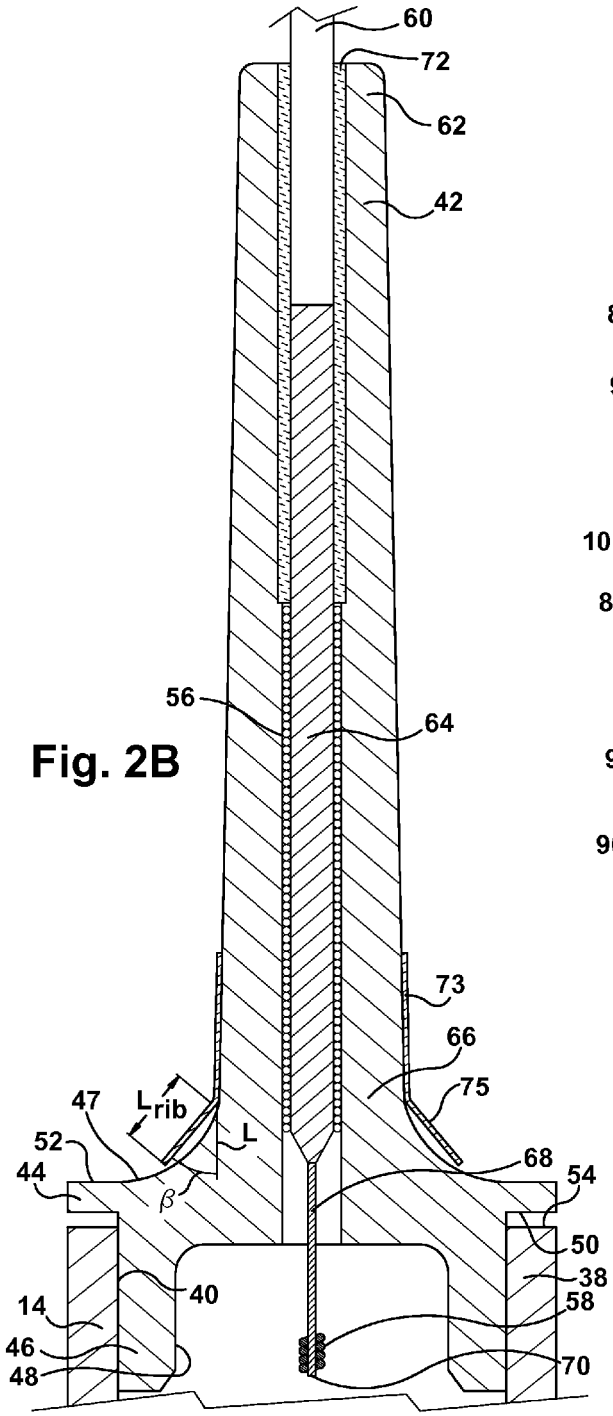
FIG. 2B is an enlarged cross-sectional view of the arc tube of FIG. 2A.

Referring to FIG. 2B, the arc tube 14 includes a tubular central barrel shaped portion 38 of constant diameter and openings 40 at either end of the barrel portion. Two legs or capillaries 42 extend from the central portion 38. The arc tube body and legs can be formed of light transmitting ceramic material such as polycrystalline alumina. Each of the legs 42 can include a flange 44 and a boss 46 extending from the flange into the opening 40 of the central portion into an interior discharge region 48 of the barrel portion 38. The portion of the legs from where there is a curvature to an outer periphery of the flange is referred to as a plug portion 47. When referring to a coverage area of the plug portion 47 it is meant a section of an outer surface of the plug portion between the foil and the outer diameter of the central portion of the arc tube. The legs each include inner flange surface 50 and outer flange surface 52, the inner flange surface 50 abutting a side face 54 of the cylindrical barrel portion 38. It should be appreciated that the invention described herein applies to a wide variety of designs of the arc tube, including central portion, legs and plug portion. The legs 42 include passages 56 along their length. The conductive feedthroughs 28, 30 extend into the passages 56 and are electrically connected to electrodes 58 that are spaced apart from each other in the discharge region. The feedthroughs 28, 30 are electrically conductive. In one example, there is a niobium feedthrough portion 60 that extends from outside the leg into the distal portion 62 of the leg remote from the central portion 38. The niobium feedthrough portion 60 is electrically connected to a molybdenum feedthrough portion 64, which can include a central wire with material coiled around it. At proximal leg portion 66 near the central portion 38 and connected to the molybdenum feedthrough is a tungsten portion 68 of the electrode 58 also including conductive material coiled around it and having a tip 70. The coils around the feedthrough portion 64 and around the tungsten portion 68 are the same material as the wire they wrap around. Those skilled in the art will appreciate in reading this disclosure that various differences in the feedthrough and electrode design and composition can be made without departing from the scope of this disclosure. A glass frit 72 is used inside the passages 56 of the legs 42 around the niobium and molybdenum feedthrough portions to hermetically seal the arc tube after ionizable material has been charged into it.

Foil 73 (or foil part) is disposed around the arc tube leg 42, for example, at a location of the molybdenum feedthrough portion 64. A crown 75 extends from the foil 73 near the central portion 38 of the arc tube, i.e., along but spaced apart from the plug portion 47. In this embodiment the crown 75 and foil 73 are integrally formed. The foil and crown are comprised of a base metal selected from the group consisting of Nb, Mo, Ta, Pt, Re, W, Ni, combinations thereof or a combination of any of the above base metals with cladding composed of one or more of the base metals. The cladding can improve weldability of the foil.

Figure 3:
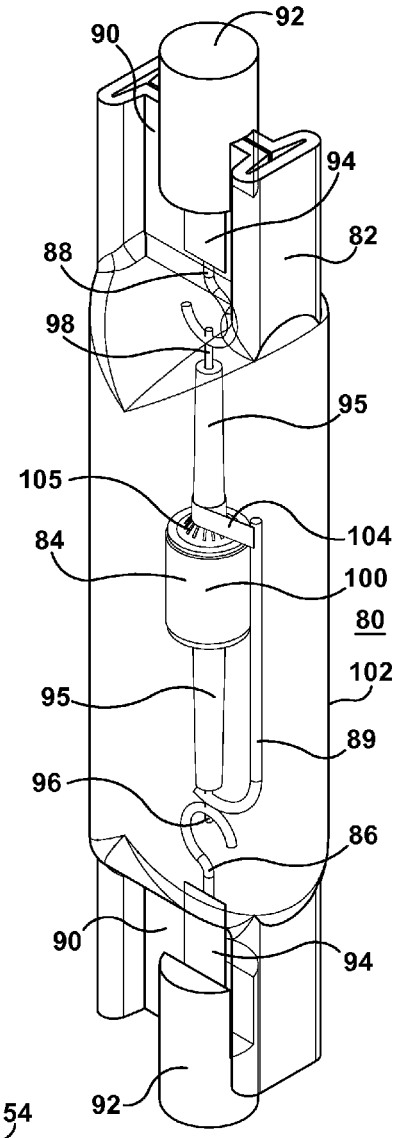
FIG. 3 is a side elevational view of a double ended high intensity discharge lamp with foil and crown ignition aid of this disclosure.

Referring to FIG. 3, a ceramic metal halide high intensity discharge lamp 80 of a second embodiment includes an outer shroud or bulb 82 enclosing an arc tube 84. This is a double ended lamp in that contacts are located at both ends of the lamp. Electrically conductive end frame members 86, 88 are embedded in glass at each of the opposite pinch portions 90 of the outer bulb 82. Contacts 92 external to the outer bulb are electrically connected to electrically conductive foil 94 located in the pinch portions 90. Each foil 94 is welded to a connector fitted into one of the contacts 92 and to one of the end frame members 86, 88. The electrical connection between the foil and contact is not shown. Electrically conductive feedthroughs 96, 98 extend into each leg 95 of the arc tube 84. The lower feedthrough 96 is welded to a central frame member 89 that extends along the length of the arc tube but is spaced apart from a side of the arc tube 100 near a side wall 102 of the outer bulb. The frame members 86, 88, 89 are made of rigid wire and support the arc tube 84 inside the outer bulb 82 preventing its movement. The central frame member 89 is electrically connected to one conductor (feedthrough 96) that extends into the arc tube 84 and supports foil 104 around the other conductor (feedthrough 98) on the other leg of the arc tube while being electrically insulated from that conductor. A crown 105 is integrally formed with the foil. The arc tube 14 and its feedthroughs 28, 30 of the lamp of the first embodiment have the same features as the arc tube 84 and its feedthroughs 96, 98. The foil 104 is integrally formed with the crown 105 and is spaced apart from a central portion 38 of the arc tube, i.e., extending along but spaced apart from the plug portion 47. It should be appreciated in reading this disclosure that the lamps of the first and second embodiments (FIGS. 1-3) could include the coated crown and foil, discussed later, instead of the integral crown and foil shown in the drawings.

Into the discharge region 48 (FIG. 2B) is charged an ionizable material including an inert gas mixture (e.g., including argon or xenon or a mixture thereof), metal halide and mercury. Krypton 85 ($Kr^{85}$) gas may also be used in the discharge region in amounts reduced to comply with government regulations; for example, a mixture of the inert gas mixture (e.g., including argon gas and/or xenon gas) and $Kr^{85}$ gas present in the discharge region can have an activity concentration of not greater than 0.16 MBq/liter. The composition of the gas in the arc tube at room temperature can be argon and/or xenon and krypton with some mercury. The dose in the lamp, for example, can include 5.7 mg of Hg and the following (weight %) metal halides: 51.2% NaI, 6.8% TlI, 16.6% $LaI_3$ and 25.4% $CaI_2$. The total dose weight of these halides can be 12 mg, for example.

Electrical current supplied to the contacts reaches the electrodes via the frame members and feedthroughs, and generates an arc between the electrodes. One electrode (e.g., the electrode connected to feedthrough 28 in FIG. 2A) is provided an AC operating voltage by the ballast while the other electrode is at the opposite potential. The electrode connected to feedthrough 30 in FIG. 2A can be grounded. Ignition voltage pulses and rms operating voltage are provided to the lamp via the ballast. It should be appreciated that the one electrode referred to above can be the opposite as what is shown and described regarding each of FIGS. 2A and 3. For example, the electrode connected to feedthrough 30 can receive the full applied voltage from the ballast while the electrode connected to feedthrough 28 is grounded. Alternatively, the applied voltage to the lamp can be a floating voltage, i.e., each electrode can have voltage applied to it in AC cycle (equal, but opposite).

The foil and crown ignition aid is used to improve ignition of the lamp. The ignition aid includes the electrically conductive foil (or foil part) 73, 104 that is fastened to the frame member (18, 89) and encircles a leg 42, 95 of the arc tube around a feedthrough extending in that leg. The foil is spaced apart and electrically insulated from the feedthrough it encircles by the electrically insulating ceramic material of the arc tube leg. While not wanting to be bound by theory it is believed that the foil (73, 104) and crown 75, 105, and feedthrough in the arc tube leg (and/or electrode in the arc tube central portion), along with the nonconductive gas in the arc tube leg, function as a capacitor. Typically, there is no electrical conductor encircling the arc tube leg opposite the ignition aid illustrated in the drawings or at the central portion of the arc tube. For example, turning to FIG. 1, there is no electrical conductor on the upper leg 42 or on the barrel portion 38 in this example. However, the foil could extend around the other leg and contact or be integrally formed with the crown there, but this lamp would employ another frame member on the other side of the lamp to which it is connected. Although the foil and crown are typically disposed proximal to the lower electrode (FIG. 1), it might also be disposed proximal to the upper electrode instead as shown in FIG. 3. The crown is typically spaced apart from the central portion of the arc tube as contact of the crown and central portion might cause overheating of the arc tube and cracking.

Figure 5:
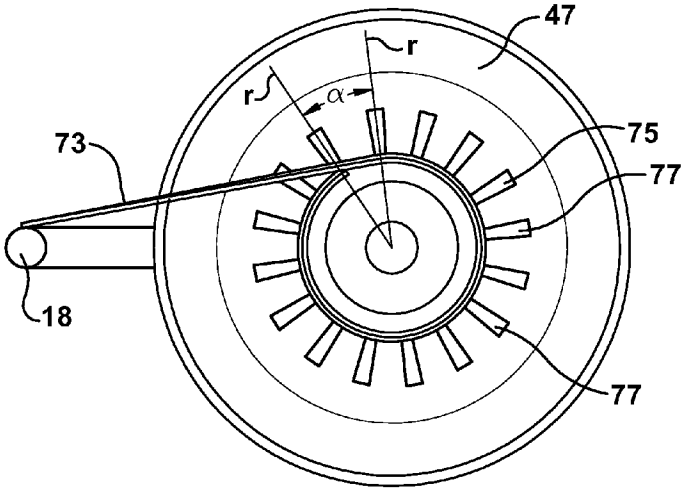
FIG. 5 is an end view of the arc tube of FIG. 4.
Figure 4:
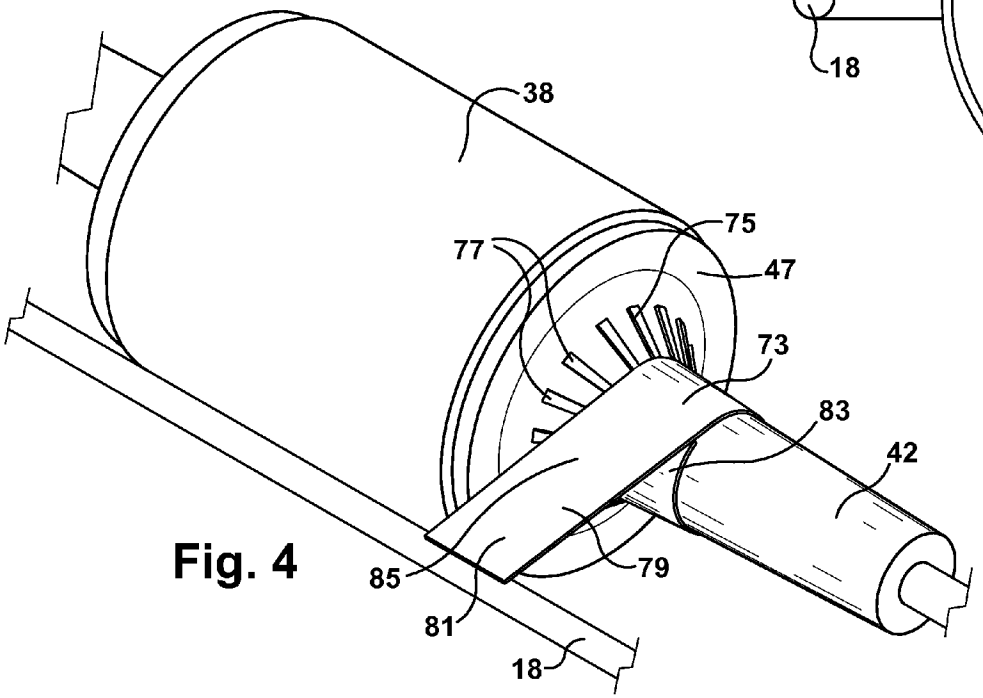
FIG. 4 is a perspective view of the arc tube with foil and integral crown.
Figure 8:
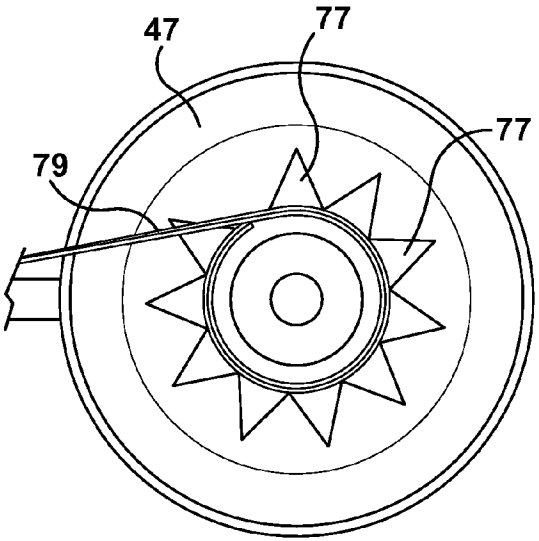
FIG. 6-8 are end views of the arc tube showing the foil and integral crowns with different rib shapes.
Figure 7:
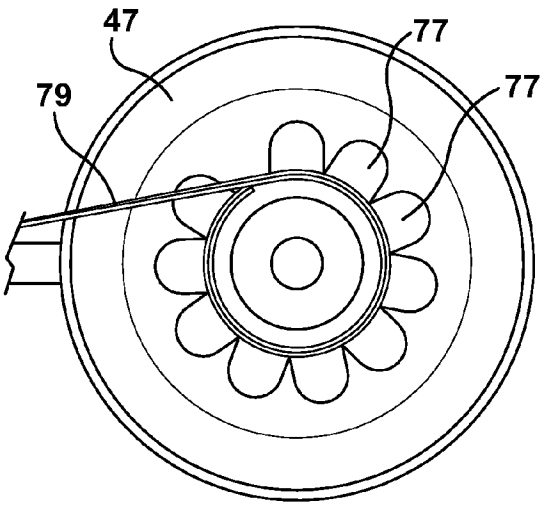
Figure 6:
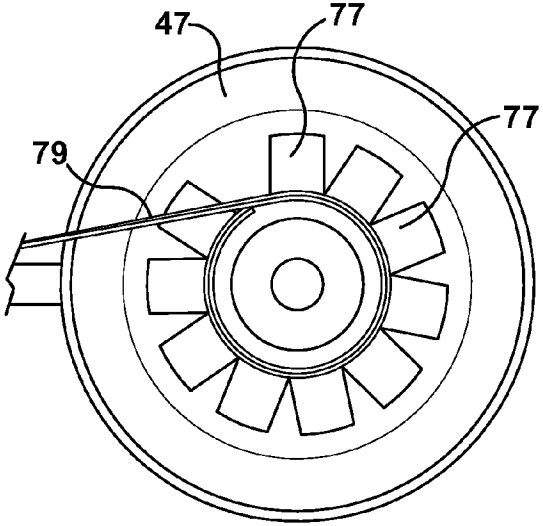

In one aspect (FIGS. 1-8), the crown 75, 105 is designed to be an integral part of the foil 73, 104 as discussed above. Referring to FIG. 4, the foil part would have the shape of the rectangular strip 79 that wraps around the leg and the crown would be cut from the foil part and bent at angle β (FIG. 2B). The rectangular strip 79 includes a first end portion 81 electrically attached to the frame member 18, a second end portion 83 electrically attached or not to a central portion 85 of the foil between the end portions. The crown can have various shapes including lamelles or ribs 77 extending radially outward from the rectangular strip 79 of foil with space between the ribs. The ribs 77 can be rectangular (FIG. 6) or trapazoidal shaped (FIG. 5), rounded (FIG. 7), or even triangular (FIG. 8) so that the crown resembles a star. As shown in FIG. 2B, the ribs 77 extend radially outward from line L which is parallel to the axis along which the arctube and leg part extend, by the angle of β. The ribs have a length of $L_{rib}$. As seen in FIG. 5 α is the angle between ribs. In particular, radial reference lines r extend from a centerpoint of the arc tube leg, in a side view of the arc tube, radially outwardly along centerlines of adjacent ribs. The angle between these radial reference lines is α.

Figure 10:
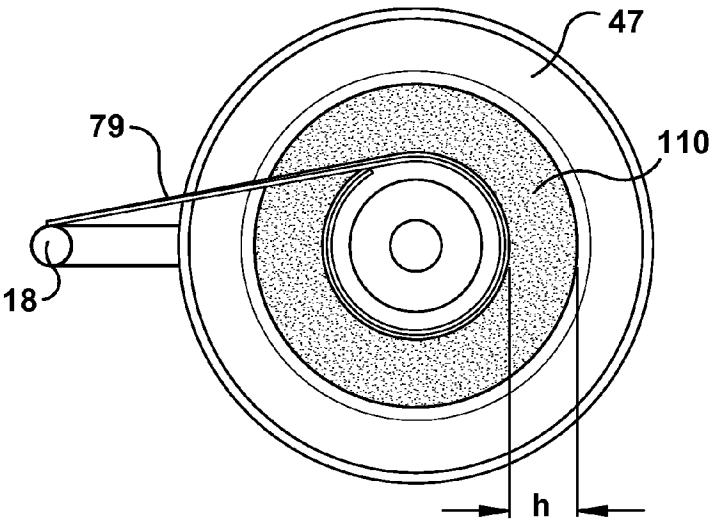
FIG. 10 is an end view of an arc tube with coated crown and foil.
Figure 9:
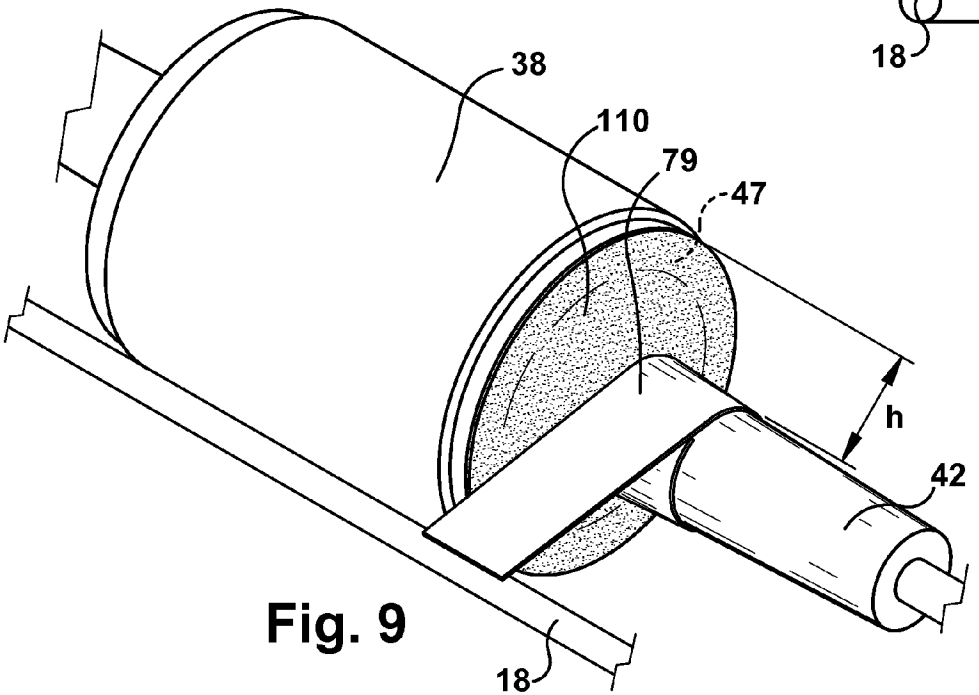
FIG. 9 is a perspective view of an arc tube with a coated crown and foil.
Figure 12:
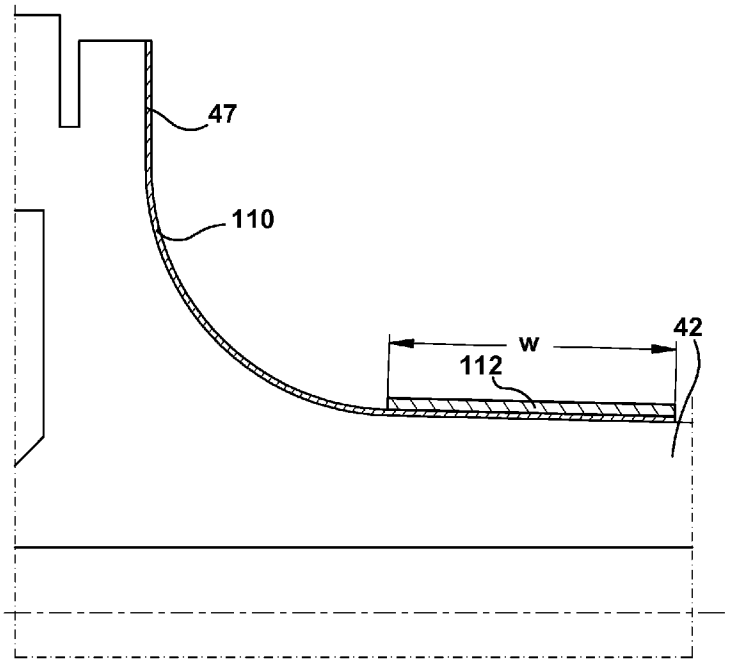
FIG. 12 is a cross-sectional side view of the crown and foil of FIGS. 11A and B.
Figure 17:
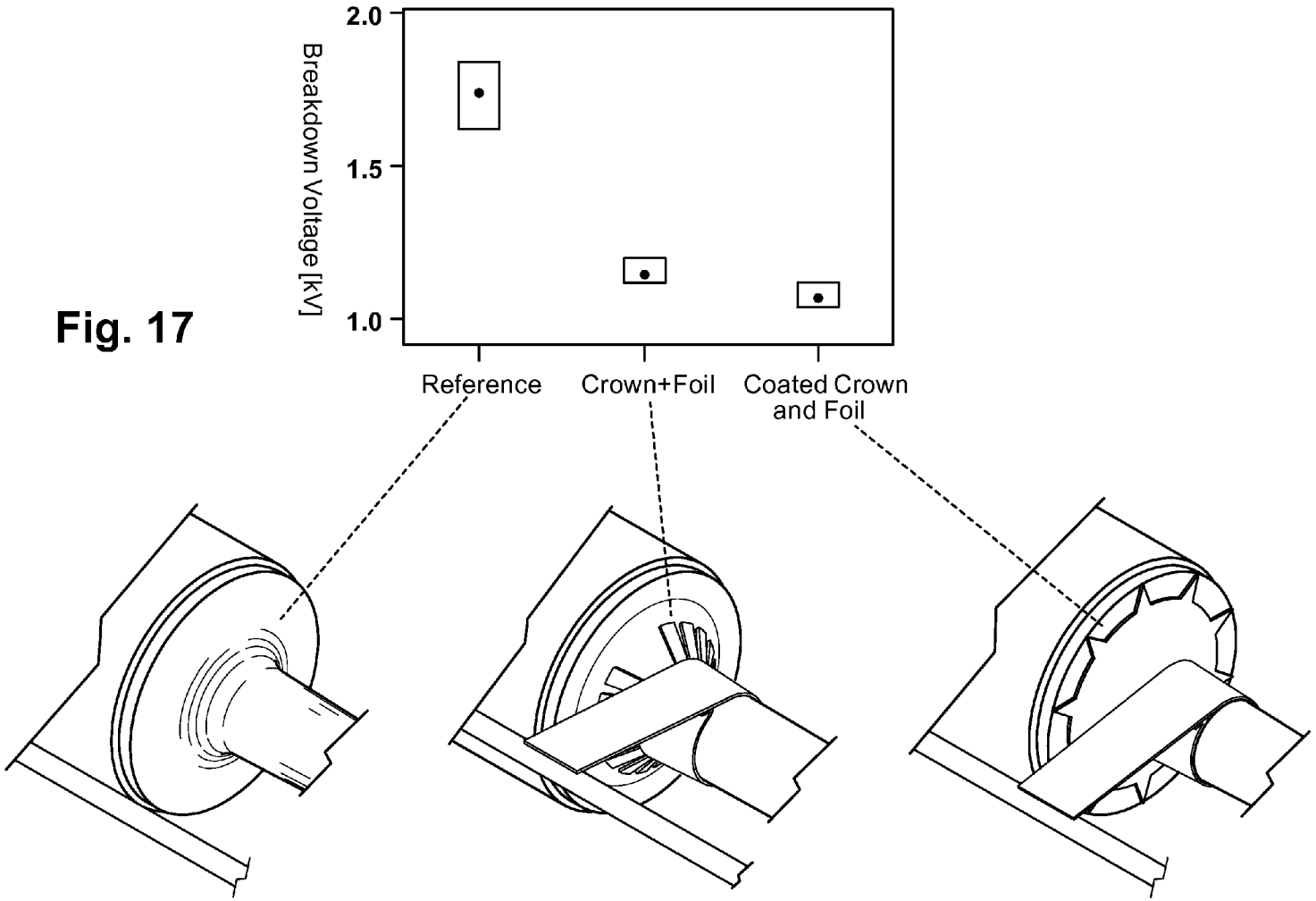
FIG. 17 is a graph showing examples of breakdown voltages for a reference arc tube without ignition aid, an arc tube with a crown and foil and an arc tube with a coated crown and foil having the designs shown in that figure.

Referring to FIGS. 9-12, in another aspect the crown can be formed as a thin "crown coating" 110 on the end of the arc tube, e.g., on the plug portion 47 of the leg 42 of the arc tube. It should be appreciated that the arc tube could be designed differently so that the end portion is part of the central barrel portion rather than the leg. The crown coating 110 can be annular shaped and cover a portion or substantially all of the surface of the end of the central portion of the arc tube, e.g., the plug portion 47 of the leg. The crown coating 110 covers a section of the plug portion 47, around the flat tapered leg, making the crown coating annular shaped. The crown coating 110 can be a ring of different thickness h (FIGS. 9 and 10). The crown coating 110 includes a portion that extends from the plug portion onto the arc tube leg and the rectangular section 112 of foil 114 is disposed above and in contact with that coating as the foil 114 is wrapped around the leg, so that the foil is in electrical contact with the crown coating (FIG. 12). The crown coating 110 can include spokes, ribs or tips 116, e.g., pointed (generally triangular) tips, forming a star shape as shown in FIGS. 11A and B. The crown coating can also include an annular body portion with the tips extending outwardly therefrom as shown in FIG. 17 (Coated Crown and Foil). $E_{max}$ increases as the surface area covered by the crown coating increases. To increase $E_{max}$ one can increase the length or overall area of spokes, ribs or tips 116. The covered area is proportional with $E_{max}$. $E_{max}$ can be increased either by increasing the number of spokes in a way to increase area that reach out to the flange or making a solid annular cover (without ribs) with increasing distance h (FIGS. 9 and 10).

Figure 11A:
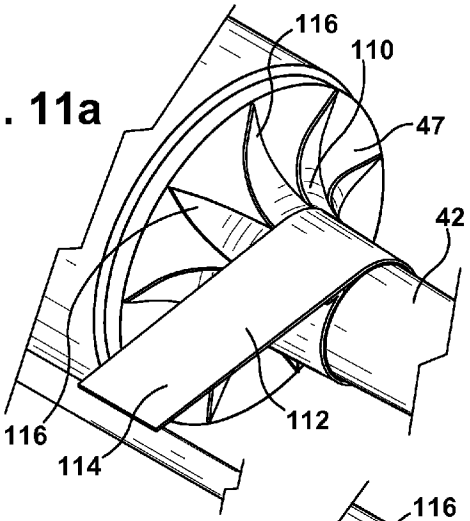
FIG. 11A is a perspective view of an arc tube with a coated crown and foil having ribs of a unique shape.
Figure 11B:
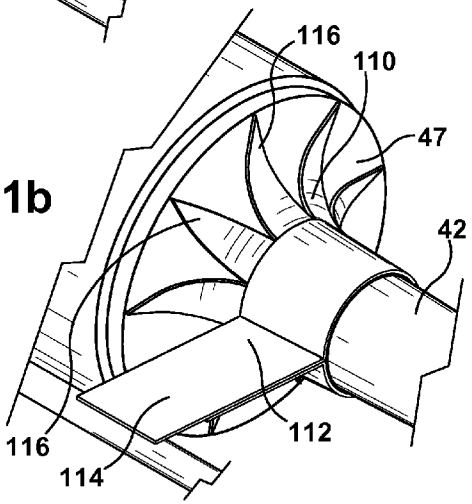
FIG. 11B is a perspective view using the same coated crown and foil of FIG. 11A but in which the foil extends from a center of the leg toward the frame member as opposed to tangential to it in FIG. 11A.

It can be seen that the foil can extend from the arc tube leg to the frame member 18, 89 in different ways. As shown in FIG. 11A, the foil extends from a tangent from the arc tube leg. In contrast, in FIG. 11B the foil extends from near a center of the arc tube leg. In both cases, one end of the foil can be electrically attached to the frame member 18, 89 as by welding, a central portion of the foil can wrap around the leg and the other end of the foil can be electrically attached to itself as by welding. In these two designs the foil substantially completely encircles the arc tube leg. It should be appreciated that these features described in this paragraph apply equally to the design in which the foil is integrally formed with the crown (FIGS. 1-8).

A width w of the rectangular strip of the foil (FIG. 12) is advantageously at least 1.0 mm, at least 1.5 mm, or more specifically, in a range of 1.0 mm to 4.0 mm, 1.0 to 3.0 mm or 1.0 to 2.0 mm. An upper limit of foil width is that the foil should not be so wide that it covers the portion of the arc tube leg where the sealing frit is located as this can overheat the sealing part causing cracks in the sealing or in the leg. Also, foils should not be so wide that they contact the plug portion excessively cooling the arc tube.

Figure 13:
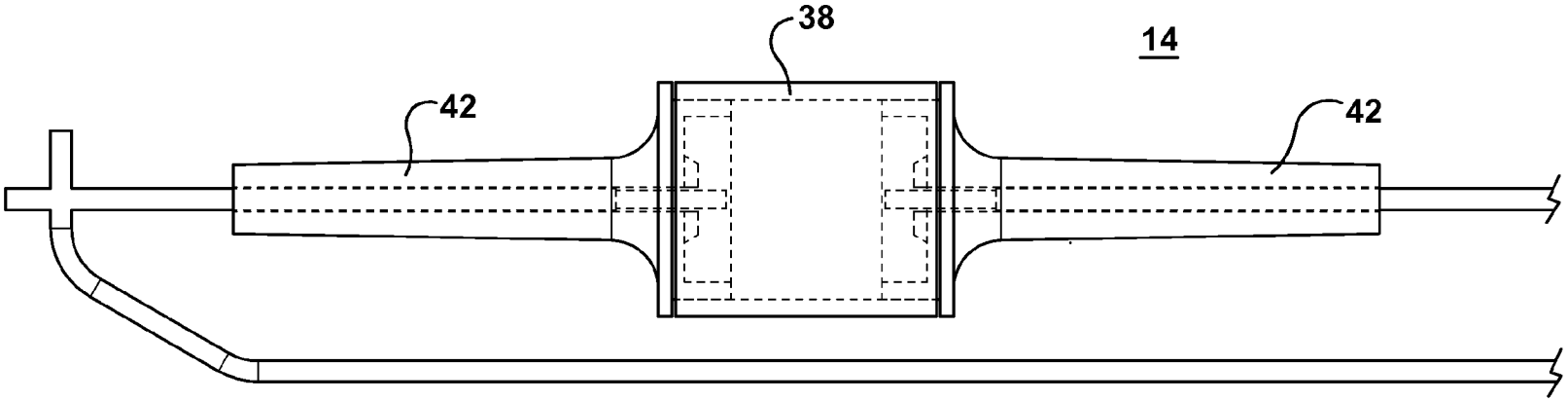
FIG. 13 is a view of an arc tube with components drawn to scale used in the simulation for Emax described in the Examples.

The reason the foil and crown are a further enhancement of the lamp starting phenomenon is described below. For purposes of explanation, a conventional discharge lamp does not have the starting aid, but contains $Kr^{85}$ gas and Ar gas. A ballast is used to apply the high voltage transient pulse between the electrodes contained in the hermetically sealed discharge region of the arc tube. Relatively high concentrations of $Kr^{85}$ gas that exceed current government regulations (e.g., 3-10 MBq/l) are used in the conventional discharge lamp to allow for the discharge to be initiated reliably over the rated life of such lamps. The electric field generated in the conventional discharge lamp is defined as the applied voltage/gap between the electrodes. The larger the gap between the electrodes, the lower the electric field. The lower the electric field, the harder it is to reliably initiate the discharge, even though $Kr^{85}$ gas and the high voltage electric pulse that is provided by the ballast, are present. Referring to FIGS. 2A and 13, including the foil and crown starting aid of this disclosure as shown, the electric field in the lamp is much higher, by virtue of the fact that the gap is now between, for example, the foil/crown and the adjacent electrode. This gap is much smaller than the gap between the electrodes and hence the electric field is much larger, and the creation of the electron avalanche that much easier. Essentially, the upper electrode has been replaced by the foil and crown, as the foil and crown are electrically connected to the upper electrode.

The lamp of this disclosure will now be described by reference to the following examples, which present more specific information that should not be used to limit the invention as described by the claims.

EXAMPLES

In the following examples $E_{max}$ simulations were performed as follows. Data was produced for ceramic metal halide discharge lamps using software by Comsol Multiphysics 2010 developed with the University of Budapest for electrostatic calculation using finite element analysis. Inputs into the software were parameters describing the geometry of the arc tube of the 39 W lamp shown in FIG. 13, material properties and an applied voltage of 1 kV. The arc tube and conductors shown in FIG. 13 were drawn to scale, the distance between the electrodes in the discharge region being 4.30 mm. The geometry was simplified for these calculations, such as by not using a coil on the electrode. The feedthrough conductors in the leg and the electrode in the discharge region were treated as being made of the same material. Finite elements analysis was used to calculate electric field based on these inputs.

Maxwell equations solved in the discharge geometry region by finite element analysis were as follows:

Gauss' law: $\nabla D=\rho$,

Electric potential: $E=-\nabla V$;

Constitutive relation: $D=\in_0 \in_r E$, which above equations produce the following differential equation that was solved for V:

$\nabla(\in_0 \in_r \nabla V)=0$, where V is the electric potential, $\in_0$ is the dielectric permittivity of a vacuum, $\in_r$ is dielectric permittivity of the material in the given modeling space, $\nabla$ is the directional derivative in the 3 directions of the Cartesian coordinate system $(\partial/\partial x)/(\partial/\partial_y)/(\partial/\partial z)$, and $\rho$ is volume density of free charges.

The software ran the finite element analysis together with adaptive meshing using a variety of numerical solvers. The AC/DC module provides an environment for simulation of electromagnetic problems in 2 and 3 dimensions. The software used static modeling without moving charges. Electric field was measured using scalar values normalized at the tip of the powered electrode. $E_{max}$ is the electric field measured in V/m at the tip of the powered electrode. The electrode proximal to the foil was treated as the powered electrode while the other electrode was at 0 potential. That unpowered electrode, the foil and the frame member were treated as grounded elements. The gas was given an $\in_r$ value of 1, the ceramic was given an $\in_r$ value of 10 and the vacuum space was given an $\in_r$ value of 1.

Example 1

Figure 14:
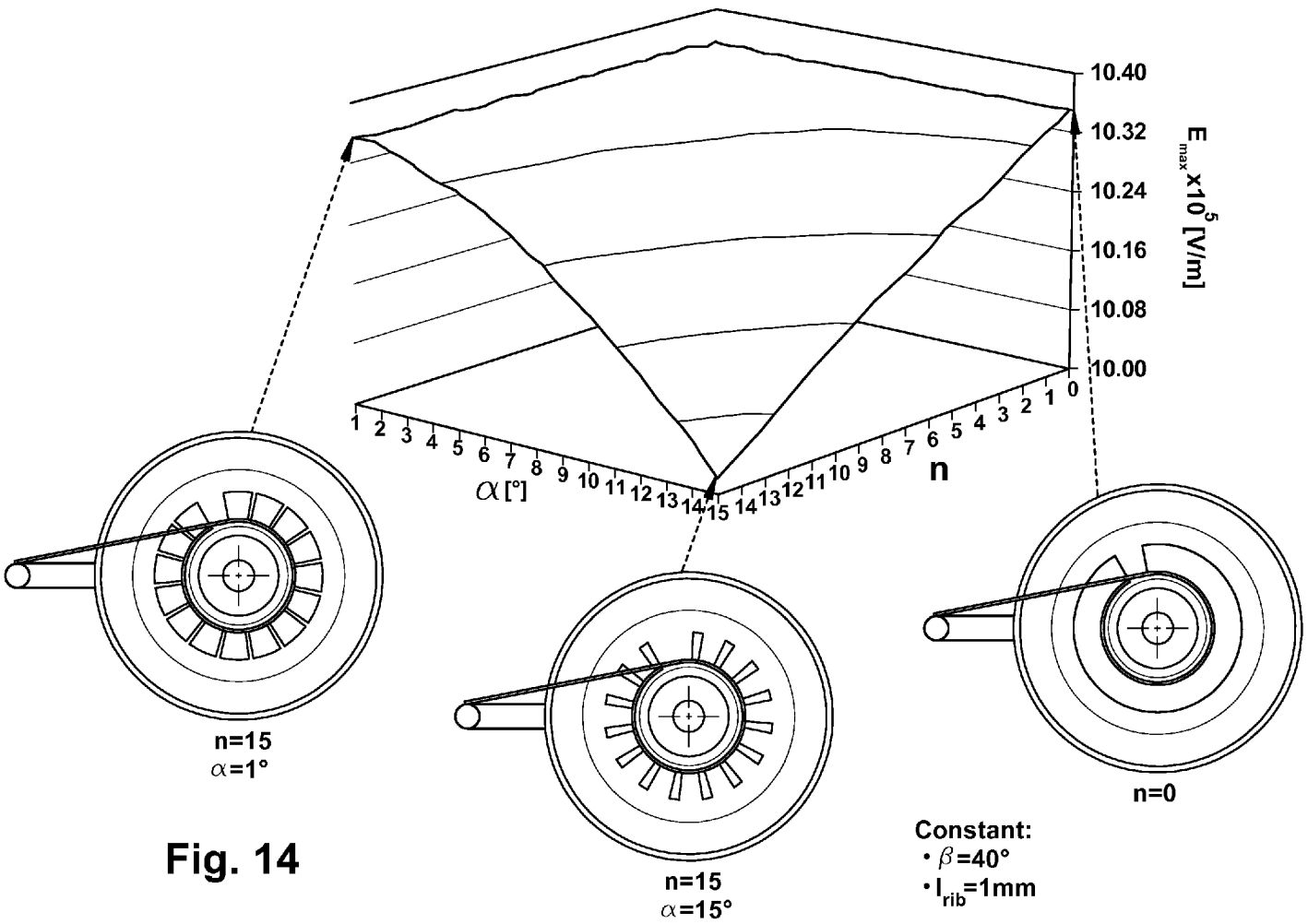
FIG. 14 is graph of Emax as a function of the angle between ribs $\alpha$ and the number of ribs n discussed in the Examples.

FIG. 14 shows a graph of $E_{max}$ calculations made using the simulations described above where a combined effect of angle $\alpha$ between the ribs and number n of ribs is shown. The ignition aid used in this simulation was an integral crown and foil. If $\alpha$ is increased, keeping all other parameters constant, a reduction of $E_{max}$ can be observed. The overall surface area of the crown is the influencing factor of generating higher level of $E_{max}$. If $\alpha$ angle is constant and n is decreased the rib width will increase and the surface area will increase too, which increases $E_{max}$. N=0 refers to a solid coating without ribs.

As can be seen from FIG. 14 desired parameters of operation are that $\alpha$ ranges from 0-15° and, in particular from 1-7°. n ranges from 1-20 and, in particular, from 5-15.

Example 2

Figure 15:
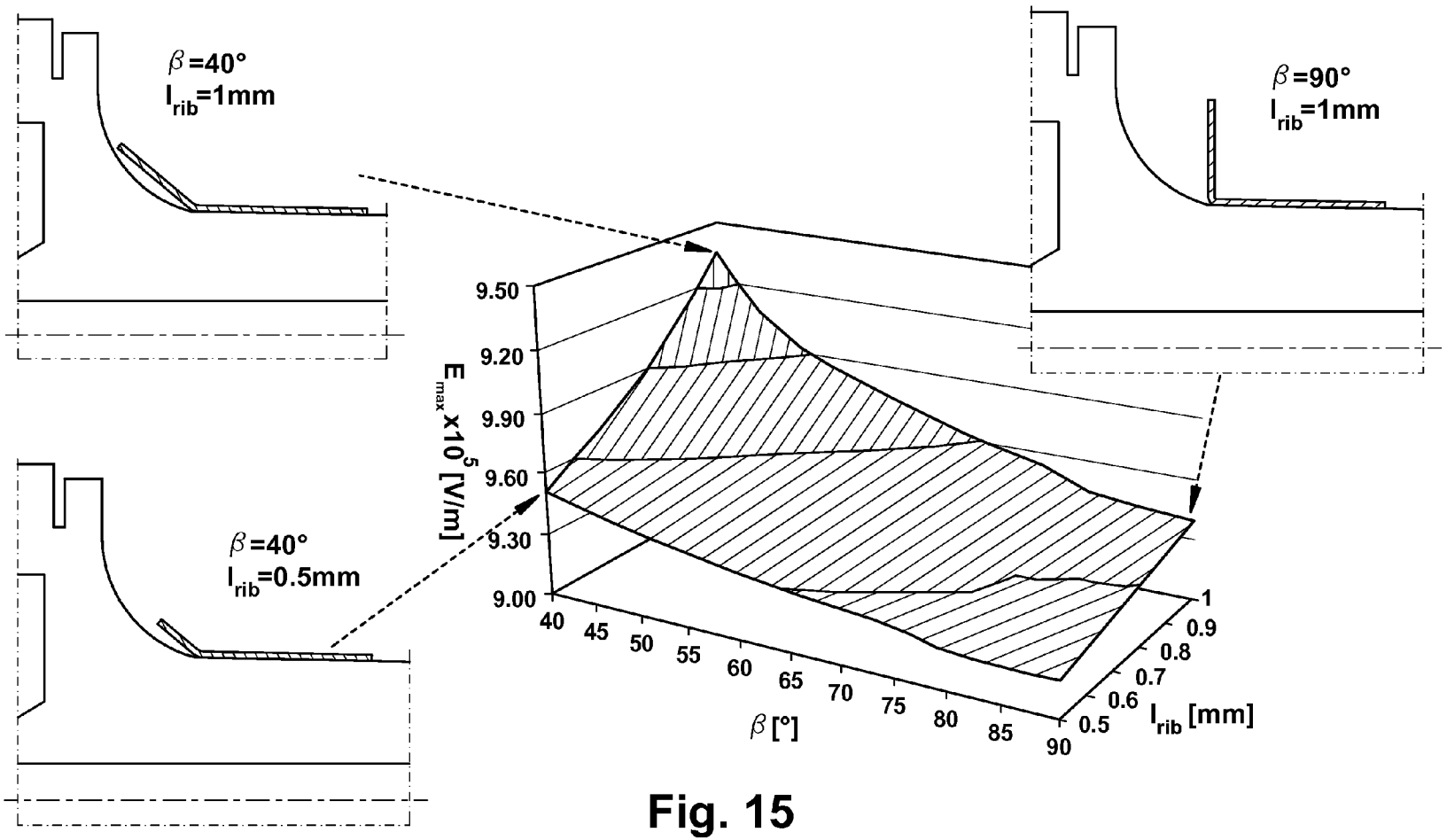
FIG. 15 is a graph of Emax as a function of the angle $\beta$ by which the ribs extend from a plane parallel to a central axis of the arc tube leg, and length of the ribs Lrib discussed in the Examples.

Referring to FIG. 15, $E_{max}$ is calculated as a function of the length of the ribs and angle $\beta$ of the ribs. $E_{max}$ is also proportional with surface area of the crown. In this simulation the ignition aid included the crown part integrally formed with the foil part. The $\beta$ angle defines the gap between the surface of the ceramic plug portion at the end of the central portion and the ribs of the crown. It also relates the distance between the powered electrode and the crown. The graph of FIG. 15 shows that if the crown is getting closer to the powered electrode (at lower values of $\beta$) $E_{max}$ is increased. From these calculations a logical conclusion can be stated. To increase the $E_{max}$ the surface area of the crown part should be increased and oriented close to the tip of the powered electrode. Following this way of thinking the end of the plug portion of the ceramic arc tube should be covered directly by a conductive coating that serves similarly to the crown part of the crown foil. This solution is the coated crown foil design.

As can be seen from FIG. 15 $E_{max}$ increases at smaller angles of $\beta$ and at larger rib lengths Lrib where $\beta$ ranges from 40 to 90° and Lrib ranges from 0.5 to 3.0 mm. The higher the $E_{max}$, the better is the ignition performance of the lamp. Desired operating conditions are that Lrib ranges from 10-70% of the outer diameter of the end portion of the arc tube (e.g., the plug portion) outside of the foil and in particular ranges from 30-70%. $\beta$ ranges from 10-80° and, in particular, from 30-60°.

Example 3

Figure 16B:
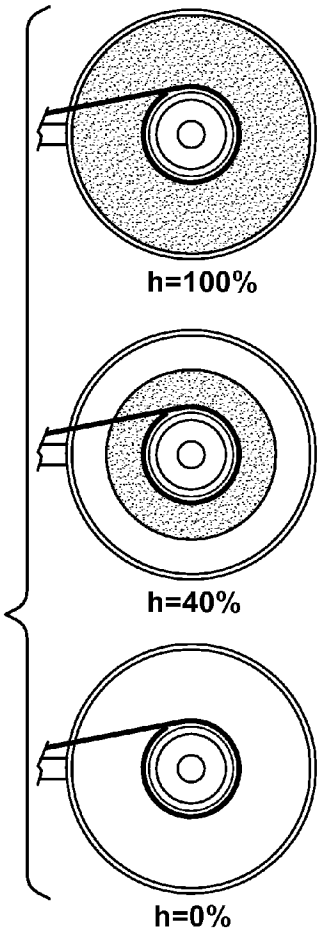
FIG. 16B shows end views of different crown coating h % on an end of the central portion of the arc tube.
Figure 16A:
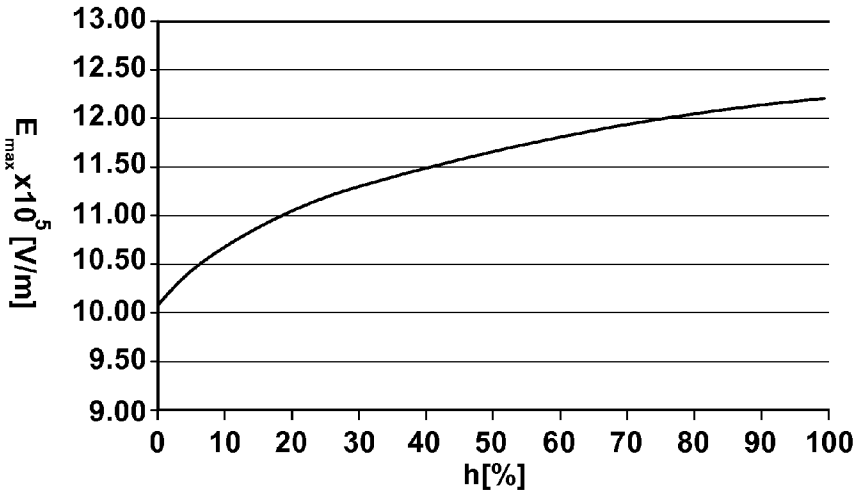
FIG. 16A is a graph of Emax as a function of the h % of the outer diameter of the arc tube that is covered by the coated crown.

Referring to FIGS. 16A and 16B, the coated crown foil design is also simulated by calculating the $E_{max}$ value as a function of the surface area of the coating. The surface area of the coating is described by the 'h' % parameter which defines the outer diameter of the coating to the outer diameter of the foil as shown in FIGS. 9, 10 and 16B. FIG. 16 shows only a trend of $E_{max}$ as a function of a parameter h which is in relation with the surface area. This function can be different depending on the shape of the coated surface. Using this coating technique, much higher $E_{max}$ was achieved by a full cover of the side end part (h=100% in FIGS. 16A and 16B). Although this starting aid design employing full coverage gives the highest $E_{max}$ and the best ignition performance of the lamp as the coating area increases, this can cause detrimental thermal effects of the arctube and can reduce light from the arctube.

Example 4

FIG. 17 and Table 1 below, show the relation between the calculated $E_{max}$ values and the measured breakdown voltages of a standard low power metal halide lamp. $E_{max}$ value are calculated by the simulation model and breakdown voltages are measured on actual lamps. For the crown foil aid design 15 ribs were used with $L_{rib}$=1 mm, $\alpha$=10° and $\beta$=40°. The width of the foil was 4 mm and the lamp wattage was 39 W. For the coated crown foil aid design the coating was made with a coating ratio of ~80% of the area of the plug portion, and the coating extended down to the leg to under the foil part. Thin aluminum foil was cut in the shape shown and used to simulate the crown coating which is referred to as "coated crown and foil."

Referring to Table 1 below, the crown ignition aid configurations created electrostatic field with higher $E_{max}$ and resulted in a lower breakdown voltage than the reference. The coated crown and foil had a higher $E_{max}$ and a lower breakdown voltage than the crown and foil design. By using the crown aid ignition aid configurations the lamp can be started more reliably using the same open circuit ignitor pulse.

TABLE 1

| | Reference | Crown and Foil | Coated Crown and Foil |
|---|---|---|---|
| Breakdown voltage (kV) | 1.74 | 1.14 | 1.07 |
| Emax ($\times 10^5$ V/m) | 6.92 | 9.94 | 12.01 |

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. A high intensity discharge lamp comprising an electrically insulating arc tube including a central portion with an interior discharge region and two legs each extending from an end of said central portion along a longitudinal axis, said central portion being a larger size than said legs, wherein each of said legs includes an elongated portion and a larger sized plug portion that is received in an opening at said end of said central portion;

electrical conductors extending through each of said legs and spaced apart from each other in said discharge region;

a light transmitting envelope enclosing said arc tube;

a frame member electrically attached to one of said conductors and extending along but spaced apart from said arc tube;

an ignition aid comprising an electrically conductive foil disposed around one of said legs and in electrical contact with said frame member, and an electrically conductive crown in electrical contact with said foil located on or near said central portion, wherein said crown includes a plurality of ribs extending generally outwardly of said foil along the longitudinal axis, wherein said crown is an integral part of said foil and is spaced apart from said plug portion, said foil including a rectangular part that wraps around said one of said legs.

2. A high intensity discharge lamp comprising an electrically insulating arc tube including a central portion with an interior discharge region and two legs each extending from an end of said central portion, said central portion being a larger size than said legs, wherein each of said legs includes an elongated portion and a larger sized plug portion that is received in an opening at said end of said central portion;

electrical conductors extending through each of said legs and spaced apart from each other in said discharge region;

a light transmitting envelope enclosing said arc tube;

a frame member electrically attached to one of said conductors and extending along but spaced apart from said arc tube;

an ignition aid comprising an electrically conductive foil disposed around one of said legs and in electrical contact with said frame member, and an electrically conductive coating disposed on said plug portion but not on said central portion over said discharge region, said coating extending on one of said legs in electrical contact with said foil, wherein said coating forms a crown that includes a plurality of ribs extending generally outwardly of said foil along the longitudinal axis.

3. The high intensity discharge lamp of claim 2 wherein a percentage of an area of said plug portion that is covered by said coating ranges from 15-100%.

4. The high intensity discharge lamp of claim 3 wherein said coating has an annular shape.

5. A high intensity discharge lamp comprising an electrically insulating arc tube including a central portion with an interior discharge region and two legs each extending from an end of said central portion along a longitudinal axis, said central portion being a larger size than said legs;

electrical conductors extending through each of said legs and spaced apart from each other in said discharge region;

a light transmitting envelope enclosing said arc tube;

a frame member electrically attached to one of said conductors and extending along but spaced apart from said arc tube;

an ignition aid comprising an electrically conductive foil disposed around one of said legs and in electrical contact with said frame member, and an electrically conductive crown in electrical contact with said foil located on or near said central portion, wherein said crown includes a plurality of ribs extending generally outwardly of said foil along the longitudinal axis, wherein said crown comprises a coating on the end of said central portion.

6. The high intensity discharge lamp of claim 5 wherein a percentage of an area of the end of said central portion that is covered by said coating ranges from 15-100%.

7. A high intensity discharge lamp comprising an electrically insulating arc tube including a central portion with an interior discharge region and two legs each extending from an end of said central portion, said central portion being a larger size than said legs;

electrical conductors extending through each of said legs and spaced apart from each other in said discharge region;

a light transmitting envelope enclosing said arc tube;

a frame member electrically attached to one of said conductors;

an ignition aid comprising an electrically conductive foil disposed around one of said legs and in electrical contact with said frame member, and an electrically conductive crown in electrical contact with said foil located on or near said central portion, wherein said crown includes a plurality of ribs extending generally outwardly of said foil, wherein a length of each rib Lrib ranges from 10-70% of the outer diameter of the central portion of the arc tube.

8. A high intensity discharge lamp comprising an electrically insulating arc tube including a central portion with an interior discharge region and two legs each extending from an end of said central portion, said central portion being a larger size than said legs;

electrical conductors extending through each of said legs and spaced apart from each other in said discharge region;

a light transmitting envelope enclosing said arc tube;

a frame member electrically attached to one of said conductors;

an ignition aid comprising an electrically conductive foil disposed around one of said legs and in electrical contact with said frame member, and an electrically conductive crown in electrical contact with said foil, wherein said crown comprises a coating on the end of said central portion, said coating having an annular shape, wherein ribs extend outwardly of said annular shape.

9. A high intensity discharge lamp comprising an electrically insulating arc tube including a central portion with an interior discharge region and two legs each extending from an end of said central portion along a longitudinal axis, said central portion being a larger size than said legs, electrical conductors extending through each of said legs and spaced apart from each other in said discharge region, wherein said electrical conductors include a first conductor in a first one of said legs and a second conductor in a second one of said legs;

a light transmitting envelope enclosing said arc tube;

a frame member electrically connected to said second conductor and extending along but spaced apart from said arc tube near said first leg;

an ignition aid comprising an electrically conductive rectangular foil part that wraps around said first leg but is electrically insulated from said first conductor and is in electrical contact with said frame member, and an electrically conductive crown that is integral with said foil part, wherein said crown includes a plurality of ribs extending generally outwardly of said foil part, along the longitudinal axis but spaced apart from said end of said central portion.

10. The high intensity discharge lamp of claim 9 wherein said ribs are triangular.

11. The high intensity discharge lamp of claim 9 wherein said ribs are rounded.

12. The high intensity discharge lamp of claim 9 wherein said ribs are generally rectangular or trapezoidal.

13. The high intensity discharge lamp of claim 9 wherein a thickness of said foil ranges from 0.05 to 0.2 mm.

14. The high intensity discharge lamp of claim 9 wherein an angle $\alpha$ between adjacent ribs ranges from 0-15°.

15. The high intensity discharge lamp of claim 9 wherein a number of ribs n ranges from 2-20.

16. The high intensity discharge lamp of claim 9 wherein said crown has an annular shape.

17. The high intensity discharge lamp of claim 9 wherein a length of each rib Lrib ranges from 10-70% of the outer diameter of the central portion of the arc tube.

18. The high intensity discharge lamp of claim 9 wherein the ribs are spaced apart from each other along an entire length of said ribs.

19. The high intensity discharge lamp of claim 9 wherein a length of each rib Lrib is at least 0.5 millimeter.

20. The high intensity discharge lamp of claim 9 wherein an angle $\beta$ between a reference line that is parallel to the longitudinal axis, and each said rib, ranges from 10-80°.

* * * * *